US005135829A

United States Patent [19]

Fukagai et al.

[11] Patent Number: 5,135,829

[45] Date of Patent: Aug. 4, 1992

[54] ELECTROPHOTOGRAPHIC PHOTOCONDUCTOR HAVING INTERMEDIATE LAYER COMPRISING MODIFIED INDIUM OXIDE

[75] Inventors: Toshio Fukagai; Kiyoshi Taniguchi; Kayoko Suzuki, all of Numazu, Japan

[73] Assignee: Ricoh Company, Ltd., Tokyo, Japan

[21] Appl. No.: 601,378

[22] Filed: Oct. 23, 1990

[30] Foreign Application Priority Data

Oct. 23, 1989 [JP] Japan ..... 1-275404
Oct. 23, 1989 [JP] Japan ..... 1-275405
Oct. 23, 1989 [JP] Japan ..... 1-275406

[51] Int. Cl.[5] ..... G03G 5/14

[52] U.S. Cl. ..... 430/60; 430/63; 430/65

[58] Field of Search ..... 430/58; 420/60, 63, 420/65, 69

[56] References Cited

U.S. PATENT DOCUMENTS 4,946,766 8/1990 Fukagai ..... 430/60

*Primary Examiner*—Marion E. McCamish
*Assistant Examiner*—Steve Rosasco
*Attorney, Agent, or Firm*—Oblon, Spivak, McClelland, Maier & Neustadt

[57] ABSTRACT

An electrophotographic photoconductor is disclosed, which comprises an electroconductive substrate, an undercoat layer formed on the electroconductive substrate, and a photoconductive layer comprising a charge generation layer and a charge transport layer formed on the undercoat layer, wherein the undercoat layer comprises a binder resin and a modified indium oxide having exothermic peaks in the range of 200° to 600° C. detected by the differential thermal analysis, which modified indium oxide is prepared by pretreatment with a hydroxyl-group-containing compound, an amino-group-containing compound, or an ether-group-containing compound.

22 Claims, No Drawings

ELECTROPHOTOGRAPHIC PHOTOCONDUCTOR HAVING INTERMEDIATE LAYER COMPRISING MODIFIED INDIUM OXIDE

BACKGROUND OF THE INVENTION

1. Field of the Invention

The present invention relates to an electrophotographic photoconductor, and more particularly to an improved electrophotographic photoconductor comprising an electroconductive substrate, an undercoat layer comprising a binder resin and a modified indium oxide formed on the electroconductive layer, and a photoconductive layer comprising a charge generation layer and a charge transport layer formed on the undercoat layer.

2. Discussion of Background

Recently, there is a tendency for organic photoconductive materials to be widely used as the photoconductors for an electrophotographic copying apparatus because of their advantages of low price, high productivity and non-polluting properties.

As the conventional organic photoconductors, there are known charge-transport type photoconductors, such as polyvinylcarbazole (PVK), and PVK-TNF (2,4,7-trinitrofluorenone), pigment-dispersion type photoconductors such as a phthalocyanine binder, and function-separation type photoconductors in which charge generating materials an charge transport materials are used in combination. Of these photoconductors, the function-separation type photoconductors attract the attention.

When a highly sensitive organic photoconductor of the aforementioned function-separation type is applied to the Carlson process, however, such a photoconductor has several drawbacks. For example, the chargeability of the photoconductor is insufficient for use in practice, and the charge retaining properties is poor so that the dark decay of electric charge is great. In addition, the above-mentioned properties of the photoconductor considerably deteriorate when the photoconductor is repeatedly used. As a result, uneven images with a low image density are produced, and the deposition of toner particles on the background of a transfer sheet readily occurs in the case of reversal development.

In general, the chargeability of a highly sensitive photoconductor is caused to decreases due to pre-exposure fatigue. The degree of the pre-exposure fatigue is mainly affected by the light-absorption of a charge generating material in a photoconductive layer of the organic photoconductor. More specifically, the charge generating material absorbs the light to generate electric charges. The longer these electric charges remain in a movable state in the photoconductive layer of the photoconductor and the greater the number of the above electric charges, the greater the reduction in the chargeability of the photoconductor due to the pre-exposure fatigue. Therefore, even if the photoconductor is charged when the electric charges generated by the light-absorption remain in the photoconductor, the surface electric charge is neutralized by the moving residual charge carriers, so that the surface potential does not increase until the residual electric charges are neutralized and consumed. The rise of the surface potential is delayed by the pre-exposure fatigue, which causes the apparent decrease in the electric potential.

In order to solve the above-mentioned problem, various intermediate layers have been proposed, for instance, intermediate layers comprising a cellulose nitrate resin in Japanese Laid-Open Patent Applications 47-6341, 48-3544 and 48-12034. Intermediate layers comprising a nylon resin in Japanese Laid-Open Patent Applications 48-47344, 52-25638, 58-30757, 58-63945, 58-95351, 58-98739 and 60-6258; intermediate layers comprising a maleic acid resin in Japanese Laid-Open Patent Applications 49-69332 and 52-10138 and intermediate layers comprising a polyvinyl alcohol resin in Japanese Laid-Open Patent Application 58-105155.

In addition to the above, the addition of various electroconductive additives to the resin components in the intermediate layers is proposed to control the electric resistivities of the intermediate layers. For instance, carbon or chalcogen is dispersed in a curing resin of an intermediate layer in Japanese Laid-Open Patent Application 51-65942; a material of an intermediate layer is thermally polymerized by use of a quaternary-ammonium-salt-containing isocyanate type curing agent in Japanese Laid-Open Patent Application 52-82238; a resistivity-controlling-agent is added to a resin of an intermediate layer in Japanese Laid-Open Patent Application 55-1180451; an oxide of aluminum or tin is dispersed in a resin of an intermediate layer in Japanese Laid-Open Patent Application 58-58556; an organometallic compound is added to a resin of an intermediate layer in Japanese Laid-Open Patent Application 58-93062; electroconductive particles are dispersed in a resin of an intermediate layer in Japanese Laid-Open Patent Applications 58-93063, 60-97363 and 60-111255; magnetite is dispersed in a resin of an intermediate layer in Japanese Laid-Open Patent Application 59-17557; finely-divided particles of $TiO_2$ and $SnO_2$ are dispersed in a resin of an intermediate layer in Japanese Laid-Open Patent Applications 59-84257, 59-93453 and 60-32054; and indium oxide is dispersed in a resin of an intermediate layer in Japanese Laid-Open Patent Application 57-81269.

However, the chargeability of the above-mentioned conventional electrophotographic photoconductors gradually decreases while in repeated use. In particular, the rise of the electric potential of the photoconductors becomes insufficient for use in practice and the change in the residual potential is considerable.

The inventors of the present invention have proposed an electrophotographic photoconductor comprising an undercoat layer in which indium oxide is dispersed in a binder resin comprising a reaction product of an active-hydrogen-containing compound and an isocyanate-group-containing compound a in Japanese Patent Application with Application No. 63-61296 (corresponding to U.S. Pat. No. 4,946,766).

The deterioration in the chargeability of the above-mentioned photoconductor is small and the change in the residual potential is slight while in use. However, in order decrease the deterioration in the chargeability and the change in the residual potential, it is necessary to increase the amount ratio of indium oxide to the binder resin. As a result, the dispersibility of indium oxide in the binder resin is lowered, so that the surface of the undercoat layer becomes rough. This brings about the formation of uneven images in the portions which correspond to the rough surface portions of the undercoat layer.

SUMMARY OF THE INVENTION

Accordingly, an object of the present invention is to provide an electrophotographic photoconductor capable of producing high quality images with high uniformity, and the electric potential of which quickly rises and the residual potential of which does not increase during the repeated charging and exposure.

The above-mentioned object of the present invention can be achieved by an electrophotographic photoconductor comprising an electroconductive substrate, an undercoat layer formed on the electroconductive substrate, and a photoconductive layer comprising a charge generation layer and a charge transport layer formed on the undercoat layer, wherein the undercoat layer comprises a binder resin and a modified indium oxide having exothermic peaks in the range of 200° to 600° C. detected by the differential thermal analysis, which modified indium oxide is prepared by pretreatment with a hydroxyl-group-containing compound, an amino-group-containing compound, and an ether-group-containing compound.

DESCRIPTION OF THE PREFERRED EMBODIMENTS

The undercoat layer of the electrophotographic photoconductor according to the present invention comprises a modified indium oxide and a binder agent.

As the indium oxide for use in the present invention, can be used not only pure indium oxide, but also indium oxides which contain or are mixed with any of (a) metallic oxides such as titanium oxide, aluminum oxide, calcium oxide, magnesium oxide, tin oxide, zirconium oxide, silicon oxide, beryllium oxide, zinc oxide and yttrium oxide; (b) metallic fluorides such as magnesium fluoride, calcium fluoride and aluminum fluoride; (c) metallic nitrides such as boron nitride, aluminum nitride and silicon nitride; (d) metallic carbides such as boron carbide and silicon carbide; and (e) metallic borides such as calcium boride and silicon boride.

The above mentioned indium oxide is modified by a pretreatment process using a hydroxyl-group-containing compound, an amino-group-containing compound or an ether-group-containing group. More specifically, in the pretreatment process, the indium oxide and any of the above compounds are mixed, stirred or kneaded in a ball mill or a sand mill under application of heat thereto. Alternatively, the mixture is subjected to ultrasonic heating. Thus, a modified indium oxide for use in the present invention can be obtained.

It is preferable that the modified indium oxide to be contained in the undercoat layer of the photoconductor according to the present invention have exothermic peaks in the range of 200° to 600° C., more preferably in the range of 260° to 350° C., when measured by the differential thermal analysis.

Examples of the hydroxyl-group-containing compounds for use in the pretreatment process are as follows: alcohols such as methanol, ethanol, propanol, butanol, amyl alcohol, fusel oil, methoxybutyl alcohol, hexanol, methyl pentanol, ethylbutyl alcohol, heptanol, octanol, ethylhexyl alcohol, nonylalcohol, dimethyl heptanol, decanol, undecyl alcohol, trimethyl nonylalcohol, tetradecyl alcohol, heptadecyl alcohol, cyclohexanol, methylcyclohexanol, trimethylcyclohexanol, benzyl alcohol, phenylmethyl carbinol, ethylene glycol, propylene glycol, butylene glycol, pentanediol, hexanediol, triethylene glycol, tripropylene glycol, glycerol, heptanediol, diethylene glycol and dipropylene glycol; methyl cellosolve, ethyl cellosolve, butyl cellosolve, ethylene glycol monohexyl ether, ethylene glycol monophenyl ether, methyl carbitol, ethyl carbitol, butyl carbitol, hexyl carbitol, terpene glycol ether, tetrahydrofurfuryl alcohol and diacetone alcohol; hydroxyl-group-containing polymers such as polyvinyl alcohol, polyvinyl acetal, phenoxy resin, polyester, alkyd resin, and polyalkylene glycol; resins containing a hydroxyl-group-containing acryl monomer unit such as a hydroxyethyl methacrylate monomer unit; and vinyl acetate resins.

Examples of the amino-group-containing compounds for use in the pretreatment process are as follows: diethylamine, triethylamine, propylamine, dipropylamine, isopropylamine, butylamine, dibutylamine, tributylamine, amylamine, diamylamine, triamylamine, ethylenediamine, propylenediamine, aniline, pyridine, quinoline and cyclohexylamine.

Examples of the ether-group-containing compounds for use in the pretreatment process are as follows: isopropyl ether, butyl ether, hexyl ether, alkyl ethers of ethylene glycol, alkyl ethers of diethylene glycol, alkyl ethers of glycerol, polyglycerols such as triglycerol, polyalkylene oxides such as derivatives of polyethylene oxide, derivatives of polypropylene oxide and derivatives of polybutylene oxide, polyphenylene oxides, cyclic ethers such as tetrahydrofuran, dioxysilane, dioxane and crown ethers, and polyvinyl ethers.

The modified indium oxide thus obtained is superior in the dispersibility in binder resins, which will become apparent as will be described later. Therefore, even when the amount ratio of the modified indium oxide to a binder resin is increased, the modified indium oxide can be uniformly dispersed in the binder resin. This makes the surface of the undercoat layer for the photoconductor smooth, so that the obtained photoconductor is capable of producing uniform images. Furthermore, even when the cycle of charging and exposure is repeated, the charged potential of the photoconductor is not decreased, and the residual electric charge thereof is not built up.

Specific examples of the binder resin for use in the undercoat layer include thermoplastic or thermal curing resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin and alkyd resin.

In particular, the binder resin for use in the present invention preferably comprises a reaction product of a compound having a plurality of active hydrogen atoms (hydrogen contained in —OH group, $—NH_2$ group, >NH group, —SH group and —COOH group) and a compound having an isocyanate group (—N=C=O group).

Examples of the compound having a plurality of active hydrogen atoms are polyvinyl acetal, phenoxy resin, polyamide, polyester, alkyd resin, polyalkylene glycol, hydroxylethyl-methacrylate-unit containing acrylic copolymers; and vinyl-alcohol-unit containing vinyl acetate polymers.

Examples of the compound having an isocyanate group are isocyanate compounds represented by R—N=C=O, such as methyl isocyanate, ethyl isocyanate, propyl isocyanate, butyl isocyanate, phenyl isocyanate, tolyl isocyanate, naphthyl isocyanate, nitrophenyl isocyanate and vinyl isocyanate; diisocyanate compounds represented by O=C=N—R—N=C=O, such as tolylene diisocyanate, hexamethylene diisocyanate, o-tolyl diisocyanate, diphenylmethane diisocyanate, naphthylene diisocyanate and a dimer of tolylene diisocyanate; triisocyanate compounds, such as triphenylmethane triisocyanate, and tris-(p-isocyanate phenyl)-thiophosphate; and polyfunctional isocyanate compounds with addition of a plurality of diisocyanate compounds and/or triisocyanate compounds.

The above compounds having active hydrogen usually react with the compounds having an isocyanate group under application of heat thereto. The reaction mixture may be heated to 30° C. to 250° C. To control the reaction, the conventional amine-based 1,8-diazabicyclo[5,4,0]undecene-7 (DBU) catalyst and metal-based catalyst can be employed.

Specific examples of the above catalyst for use in the present invention are tetramethylbutane diamine (TMBDA), 1,4-diaza-bicyclo[2,2,2]octane (DABCO), dibutyl tin dilaurate (DBTDL), tin octoate, N-ethylmorpholine, triethylamine, N,N,N',N'-tetramethyl-1,3-butanediamine, cobalt naphthenate, stannous chloride, tetra-n-butyl tin, stannic chloride, trimethyl tin hydroxide, dimethyl tin dichloride, and phenolic salts of DBU.

The amount ratio of the modified indium oxide contained in the undercoat layer of the photoconductor according to the present invention is not especially limited, but it is preferable that the amount of the modified indium oxide be 70 wt. % or more, more preferably in the range of about 80 to 90 wt. % of the total weight of the modified indium oxide and the above-mentioned binder resin from the viewpoints of the photosensitivity and the prevention of decrease in the chargeability while in use.

It is preferable that the thickness of the undercoat layer for use in the present invention be in the range of 0.2 to 20 μm, more preferably in the range of 0.5 to 5 μm. When the thickness of the undercoat layer is within the above range, the effect of the undercoat layer is sufficiently exerted and the residual electric charges do not accumulate in the photoconductor.

In the present invention, the undercoat layer can be prepared by coating a solution or dispersion of the previously mentioned components on an electroconductive substrate, followed by curing the coated solution or dispersion by drying.

The electroconductive substrate can be prepared by coating an electroconductive material with a volume resistivity of $10^{16}$ Ω·cm or less, for example, metals such as aluminum, nickel, chromium, nichrome, copper, silver, gold and platinum; and metallic oxides such as tin oxide and indium oxide on a film- or drum-shaped plastic sheet or paper by deposition or sputtering. Alternatively, the film- or drum-shaped plastic film in which the above-mentioned metals or electroconductive carbon particles are dispersed can be used as the electroconductive substrate. The electroconductive substrate can also be obtained by forming a sheet of aluminum, aluminum alloys, nickel or stainless into a rough tube by extrusion or drawing, and subjecting the tube to cutting and abrasion.

The photoconductive layer of the electrophotographic photoconductor according to the present invention will now be explained in detail.

In the present invention, the photoconductive layer comprises a charge generation layer and a charge transport layer.

The charge generation layer comprises a charge generating material.

Specific examples of the charge generating material for use in the charge generation layer are as follows: organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); a phthalocyanine pigment having a polyphyline skeletone; an azulenium pigment; a squaric pigment; an azo pigment having a carbazole skeleton (Japanese Laid-Open Patent Application 53-138229), an azo pigment having a triphenylamine skeleton (Japanese Laid-Open Patent Application 53-95033), an azo pigment having a stilstilbene skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734) and a triazo pigment having a carbazole skeleton (Japanese Laid-Open Patent Applications 57-195767and 57-195768); a phthalocyanine pigment such as C.I Pigment Blue 16 (C.I. 74100); indigo pigments such as C.I. Vat Brown 5 (C.I. 73410) and C.I. Vat Dye (C.I. 73030); and perylene pigments such as Algol Scarlet B (made by Violet Co., Ltd.) and Indanthrene Scarlet R (made by Bayer Co., Ltd.). Of these charge generating materials, azo pigments are preferably employed in the present invention. These charge generating materials can be used alone or in combination.

The charge generation layer may further comprise a binder resin when necessary.

Specific examples of the binder agent for use in the present invention are polyamide, polyurethane, polyester, epoxy resin, polyketone, polycarbonate, silicone resin, acrylic resin, polyvinyl butyral, polyvinyl formal, polyvinylketone, polystyrene, poly-N-vinylcarbazole and polyacrylamide.

It is preferable that the amount of the binder resin contained in the charge generation layer be in the range of 0 to 100 parts by weight, and more preferably in the range of 0 to 50 parts by weight to 100 parts by weight of the charge generating material.

The charge generation layer can be formed, for example, as follows:

The above-mentioned charge generating material, with addition of a binder resin when necessary, is dispersed together with a solvent such as tetrahydrofuran, cyclohexanone, dioxane and dichloroethane in a ball mill, an attritor, or a sand mill, to prepare a dispersion of the charge generating material. This dispersion is coated on the substrate by a conventional coating method such as dip coating, spray coating and bead coating, and then dried.

It is preferable that the thickness of the charge generation layer be in the range of about 0.01 to 5 μm, and more preferably in the range of 0.1 to 2 μm.

The charge transport layer mainly comprises a charge transporting material. The charge transport layer may further comprise a binder resin when necessary.

The charge transport layer can be prepared by dissolving or dispersing the above-mentioned charge transporting material and binder resin in an appropriate solvent to obtain a coating solution, coating the above prepared coating solution on the charge generation layer, and then drying it.

As the charge transporting materials, there are positive hole transporting materials and electron transporting materials.

Examples of the positive hole transporting materials include electron donor type materials such as poly-N-vinylcarbazole and derivatives thereof, poly-γ-carbazolyl ethyl glutamate and derivatives thereof, pyrene-formaldehyde condensation products and derivatives thereof, polyvinyl pyrene, polyvinyl phenanthlene, oxazole derivatives, oxadiazole derivatives, imidazole derivatives, triphenylamine derivatives, 9-(p-diethylaminostyryl)anthracene, 1,1-bis-(4-dibenzylaminophenyl)propane, styrylanthracene, styrylpyrazoline, phenylhydrazones and α-phenylstilbene derivatives.

Examples of the electron transporting materials are electron receiving type materials such as chloranil, bromanil, tetracyanoethylene, tetracyanoquinone dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one and 1,3,7-trinitrodibenzothiophene-5,5-dioxide.

These charge transporting materials can be used along or in combination.

The charge transport layer may further comprise the binder resin when necessary. The same thermoplastic resins and thermal curing resins as employed in the undercoat layer can be employed in the charge transport layer.

Specific examples of the solvent which is used for preparing the coating solution of each layer are tetrahydrofuran, dioxane, toluene, monochlorobenzene, dichloroethane and methylene chloride.

The proper thickness of the charge transport layer is 5 to 100 μm.

The charge transport layer for use in the present invention may further comprise a plasticizer and a leveling agent. As the plasticizer, dibutyl phthalate and dioctyl phthalate can be used. It is preferable that the amount ratio of the plasticizer in the charge transport layer be in the range of about 0 to 30 parts by weight to 100 parts by weight of the total amount of the binder resin contained therein. As the leveling agent, silicone oils such as dimethylsilicone oil and methylphenyl-silicone oil can be used in the charge transport layer. It is preferable that the amount ratio of the leveling agent in the charge transport layer be in the range of about 0 to 1 part by weight to 100 parts by weight of the total amount of the binder resin contained therein.

In the electrophotographic photoconductor according to the present invention, a protective layer or overcoat layer may be formed on the photoconductive layer in order to protect the photoconductive layer from mechanical wear and exposure to ozone during the charging operation. In addition, an adhesive layer may be interposed between the electroconductive substrate and the undercoat layer to improve the adhesion therebetween.

Other features of this invention will become apparent in the course of the following description of exemplary embodiments, which are given for illustration of the invention and are not intended to be limiting thereof.

PREPARATION EXAMPLE 1-1

Preparation of Modified Indium Oxide 1-1

One part by weight of finely-divided particles of indium oxide with an average particle diameter of 0.01 to 0.03 μm and 5 parts by weight of butanol were placed in a glass container equipped with a reflux condenser. The above mixture was refluxed with stirring for one hour.

The mixture was then subjected to an ultrasonic treatment for 30 minutes to obtain a dispersion. The thus obtained dispersion was filtered and the residue was dried at 100° C. in vacuo, whereby about one part by weight of brownish modified indium oxide 1-1 was obtained.

This modified indium oxide 1-1 was found to have a exothermic peak in the range of 295° C. to 315° C. by a differential thermal analysis.

PREPARATION EXAMPLE 1-2

Preparation of Modified Indium Oxide 1-2

One part by weight of finely-divided particles of indium oxide with an average particle diameter of 0.01 to 0.03 μm and 10 parts by weight of cyclohexanol were placed in a glass container equipped with a reflux condenser. The above mixture was refluxed with stirring for one hour, whereby a dispersion was obtained.

The thus obtained dispersion was filtered and the residue was dried at 100° C. in vacuo, whereby brownish modified indium oxide 1-2 was obtained.

PREPARATION EXAMPLE 1-3

Preparation of Modified Indium Oxide 1-3

One part by weight of finely-divided particles of indium oxide with an average particle diameter of 0.01 to 0.03 μm and 10 parts by weight of methanol were placed in a glass container equipped with a reflux condenser. The above mixture was refluxed with stirring for one hour to obtain a dispersion.

The thus obtained dispersion was filtered and the residue was dried at 100° C. in vacuo, whereby brownish modified indium oxide 1-3 was obtained. The thus obtained modified indium oxide 1-3 was found to have exothermic peaks at 260° C. and 315° C. by the differential thermal analysis.

PREPARATION EXAMPLE 1-4

Preparation of Modified Indium Oxide 1-4

One part by weight of finely-divided particles of indium oxide with an average particle diameter of 0.01 to 0.03 μm and 5 parts by weight of a methyl chloride solution of a commercially available polyvinyl butyral (Trademark "S-Lec BL-1", made by Sekisui Chemical Co., Ltd.), with a solid component content of 1.3 wt. %, were placed in a glass container equipped with a reflux condenser. The above mixture was refluxed with stirring for one hour.

The mixture was then subjected to an ultrasonic treatment for 30 minutes to obtain a dispersion. The thus obtained dispersion was filtered and the residue was dried at 100° C. in vacuo, whereby about one part by weight of brown-green modified indium oxide 1-4 was obtained.

PREPARATION EXAMPLE 1-5

Preparation of Modified Indium Oxide 1-5

One part by weight of finely-divided particles of indium oxide with an average particle diameter of 0.01 to 0.03 μm and 5 parts by weight of an aqueous solution of a commercially available polyvinyl alcohol (Trademark "#200", made by Kanto Chemical Co., Inc.), with a solid component content of 1.3 wt. %, were placed in a glass container equipped with a reflux condenser. The above mixture was heated at about 90° C. with stirring for one hour.

The mixture was then subjected to an ultrasonic treatment for 30 minutes to obtain a dispersion. The thus obtained dispersion was filtered and the residue was dried at 100° C. in vacuo, whereby about one part by weight of brown-green modified indium oxide 1-5 was obtained.

COMPARATIVE PREPARATION EXAMPLE 1-1

Preparation of Comparative Modified Indium Oxide 1-1

One part by weight of finely-divided particles of indium oxide with an average particle diameter of 0.01 to 0.03 μm and 5 parts by weight of methylene chloride were placed in a glass container equipped with a reflux condenser. The above mixture was refluxed with stirring for one hour.

The mixture was then subjected to an ultrasonic treatment for 30 minutes to obtain a dispersion.

The thus obtained dispersion was filtered, and the residue was dried at 100° C. in vacuo, whereby about one part by weight of light yellow comparative modified indium oxide 1-1 was obtained. The thus obtained modified indium oxide 1-1 was found to have an exothermic peak at 250° C. by a differential thermal analysis.

EXAMPLE 1-1

Formation of Undercoat Layer 24 g of finely-divided particles of the above-prepared modified indium oxide 1-1 and 64 g of a cyclohexane solution of a commercially available butyral resin (Trademark "S-Lec BL-1", made by Sekisui Chemical Co., Ltd.), with a solid component content of amount of 6.3 wt. %, were placed in a 9-cm diameter hard glass pot, together with YTZ zirconia balls with a diameter of 0.5 cm which took up a half of the pot.

The above mixture was subjected to milling for 3 days. After the completion of milling, 41 g of a methyl ethyl ketone solution of a commercially available isocyanate type curing agent (Trademark "Barnock D750", made by Dainippon Ink & Chemicals, Incorporated) with a content of 2 wt. % was added to the above mixture, followed by shaking the mixture for about 5 minutes. Thus, an undercoat layer coating liquid was prepared.

The thus prepared undercoat layer coating liquid was spray-coated on an aluminum drum with a thickness of 80 mm: and dried at 130° C. for one hour, so that an undercoat layer with a thickness of about 2 μm was formed on the aluminum drum substrate.

Preparation of Charge Generation Layer 20 g of an azo pigment having the following formula and 300 g of a cyclohexane solution of a commercially available butyral resin (Trademark "XYHL", made by Union Carbide Corp.) with a solid component content of 0.2 wt. % were placed in a 15-cm diameter glass pot together with YTZ zirconia balls with a diameter of 1.0 cm which took up a half of the pot.

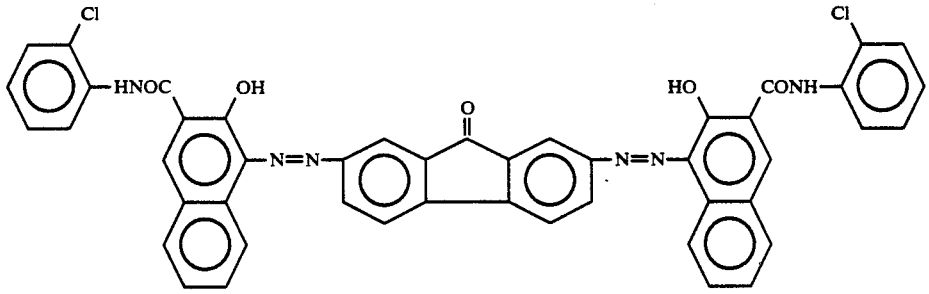

The above mixture was subjected to milling over a period of 120 hours. After the completion of milling, 500 g of methyl ethyl ketone was added to the above mixture, followed by additional milling for 24 hours. Thus, a charge generating layer coating liquid was prepared.

The thus prepared charge generating layer coating liquid was dip-coated on the above prepared undercoat layer and dried at 120° C. for about 20 minutes, so that a charge generation layer with a thickness of about 0.1 μm was formed on the undercoat layer.

Preparation of Charge Transport Layer

The following components were mixed to prepare a charge transport layer coating liquid:

| | Parts by Weight |
|---|---|
| 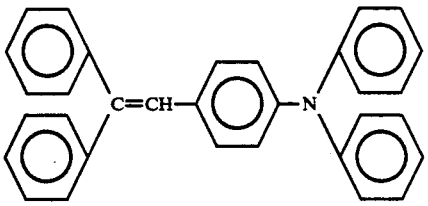  | 80 |
| Polycarbonate (Trademark "Panlite C1400", made by Teijin Limited.) | 100 |
| Silicone oil (Trademark "KF-50", made by Shin-Etsu Silicone Co., Ltd.) | 0.3 |
| Methylene chloride | 900 |

The above prepared charge transport layer coating liquid was dip-coated on the above prepared charge generation layer and dried at 120° C. for 30 minutes, so that a charge transport layer with a thickness of about 25 μm was formed on the charge generation layer.

Thus, electrophotographic photoconductor No. 1-1 according to the present invention was prepared.

EXAMPLE 1-2

The procedure for preparation of electrophotographic photoconductor No. 1-1 in Example 1-1 was repeated except that the modified indium oxide 1-1 employed in the undercoat layer in Example 1-1 was replaced by the modified indium oxide 1-2 which was prepared in Preparation Example 1-2, and except that the charge transport layer coating liquid employed in Example 1-1 was replaced by a charge transport layer coating liquid with the following formulation, whereby an electrophotographic photoconductor No. 1-2 according to the present invention was prepared.

| | Parts by Weight |
|---|---|
| 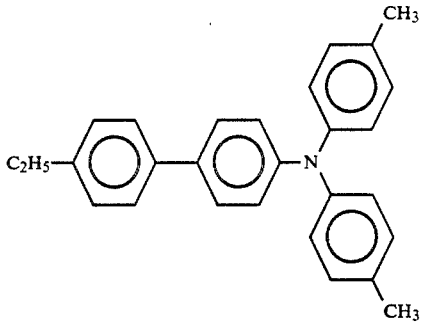 | 80 |
| Polycarbonate (Trademark "Panlite C1400", made by Teijin Limited. | 100 |
| Silicone oil (Trademark "KF-50", made by Shin-Etsu Silicone Co., Ltd.) | 0.3 |
| Methylene chloride | 900 |

EXAMPLE 1-3

The procedure for preparation of electrophotographic photoconductor No. 1-1 in Example 1-1 was repeated except that the modified indium oxide 1-1 employed in the undercoat layer in Example 1-1 was replaced by the modified indium oxide 1-3 which was prepared in Preparation Example 1-3, whereby electrophotographic photoconductor No. 1-3 according to the present invention was prepared.

EXAMPLE 1-4

The procedure for preparation of electrophotographic photoconductor No. 1-1 in Example 1-1 was repeated except that the modified indium oxide 1-1 employed in the undercoat layer in Example 1-1 was replaced by the modified indium oxide 1-4 which was prepared in Preparation Example 1-4, and except that the solid component content in the cyclohexane solution of the butyral resin employed for preparing the undercoat layer in Example 1-1 was changed to 3 wt. %, whereby electrophotographic photoconductor No. 1-4 according to the present invention was prepared.

EXAMPLE 1-5

The procedure for preparation of electrophotographic photoconductor No. 1-4 in Example 1-4 was repeated except that the modified indium oxide 1-4 employed in the undercoat layer of Example 1-4 was replaced by the modified indium oxide 1-5 which was prepared in Preparation Example 1-5, whereby electrophotographic photoconductor No. 1-5 according to the present invention was prepared.

EXAMPLE 1-6 to 1-8

The procedure for preparation of electrophotographic photoconductor No. 1-1 in Example 1-1 was repeated except that the solid component content in the cyclohexane solution of the butyral resin (Trademark "S-Lec BL-1", made by Sekisui Chemical Co., Ltd.) employed in Example 1-1 was changed to 4.7 wt. %, 5.4 wt. %, and 7.5 wt. %, whereby electrophotographic photoconductors No. 1-6 to No. 1-8 according to the present invention were respectively prepared.

COMPARATIVE EXAMPLES 1-1 to 1-4

The procedure for preparation of electrophotographic photoconductor No. 1-1 in Example 1-1 was repeated except that the modified indium oxide 1-1 employed in the undercoat layer in Example 1-1 was replaced by an unmodified indium oxide, and except that the solid component content in the cyclohexane solution of the butyral resin (Trademark "S-Lec BL-1", made by Sekisui Chemical Co., Ltd.) employed in Example 1-1 was changed to 4.7 wt. %, 5.4 wt. %, 6.3 wt. % and 7.5 wt. %, whereby comparative electrophotographic photoconductors No. 1-1 to No. 1-4 were respectively prepared.

COMPARATIVE EXAMPLE 1-5

The procedure for preparation of electrophotographic photoconductor No. 1-1 in Example 1-1 was repeated except that the modified indium oxide 1-1 employed in the undercoat layer in Example 1-1 was replaced by the comparative modified indium oxide 1-1 which was prepared in Comparative Preparation Example 1-1, whereby comparative electrophotographic photoconductor No. 1-5 was prepared.

Each of the above-prepared electrophotographic photoconductors No. 1-1 to No. 1-8 according to the present invention and comparative electrophotographic photoconductors No. 1-1 to No. 1-5 was evaluated with respect to the changes in the chargeability ($V_D$), photosensitivity ($V_L$) and residual potential ($V_R$) during the repeated use thereof. The evaluation results are shown in Table 1.

In the evaluation, each photoconductor drum was driven to rotate at 80 rpm and the surface thereof was negatively charged in the dark under application of −7.5 kV of charging.

Then, each photoconductor was illuminated through a slit of 10 mm, in such a manner that the illuminance on the illuminated surface of the photoconductor was 30 lux.

After the exposure, the photoconductor was illuminated through a slit of 10 mm, in such a manner that the illuminance on the illuminated surface thereof was 350 lux to quench the electric charge thereon.

In Table 1, $V_D$, $V_L$, and $V_R$ respectively indicate the surface potential after the above charging, the surface potential after the above exposure and the surface potential after the above quenching.

The above-mentioned process of charging, exposure and quenching was repeated for one hour, and then the surface potential after the charging ($V'_D$), the surface potential after the exposure ($V'_L$) and the surface potential after the quenching ($V'_R$) were also measured. The results are also shown in Table 1.

In Table 1, "Ratio of Modified Indium Oxide/-Binder" denotes the ratio of modified indium oxide to binder resin employed in each undercoat layer.

TABLE 1

| | Compound for pretreatment of Indium Oxide | Ratio of Modified Indium Oxide/ Binder Resin | Initial Characteristics | | | Characteristics after Repeated Operations | | |
|---|---|---|---|---|---|---|---|---|
| | | | $V_D$ | $V_L$ | $V_R$ | $V'_D$ | $V'_L$ | $V'_R$ |
| Ex. 1-1 | Butanol | 6/1 | 900 | 125 | 20 | 865 | 130 | 25 |
| Ex. 1-2 | Cyclohexanol | 6/1 | 910 | 125 | 20 | 860 | 135 | 30 |
| Ex. 1-3 | Methanol | 6/1 | 890 | 130 | 25 | 860 | 140 | 30 |
| Ex. 1-4 | Polyvinyl butyral | Approx. 12/1 | 925 | 120 | 10 | 895 | 130 | 15 |
| Ex. 1-5 | Polyvinyl alcohol | 12/1 | 915 | 125 | 15 | 890 | 130 | 20 |
| Ex. 1-6 | Butanol | 8/1 | 880 | 115 | 10 | 810 | 125 | 20 |
| Ex. 1-7 | Butanol | 7/1 | 895 | 120 | 15 | 830 | 130 | 20 |
| Ex. 1-8 | Butanol | 5/1 | 930 | 130 | 20 | 895 | 140 | 35 |
| Comp. Ex. 1-1 | Not pretreated | 8/1 | 930 | 140 | 20 | 685 | 150 | 30 |
| Comp. Ex. 1-2 | Not pretreated | 7/1 | 925 | 155 | 25 | 705 | 165 | 40 |
| Comp. Ex. 1-3 | Not pretreated | 6/1 | 950 | 170 | 30 | 780 | 190 | 55 |
| Comp. Ex. 1-4 | Not pretreated | 5/1 | 980 | 180 | 45 | 895 | 200 | 70 |
| Comp. Ex. 1-5 | Methylene chloride | 6/1 | 870 | 140 | 30 | 750 | 155 | 45 |

PREPARATION EXAMPLE 2-1

Preparation of Modified Indium Oxide 2-1

One part by weight of finely-divided particles of indium oxide with an average particle diameter of 0.01 to 0.03 μm and 5 parts by weight of n-butylamine were placed in a glass container equipped with a reflux condenser. The above mixture was refluxed with stirring for one hour.

The mixture was then subjected to an ultrasonic treatment for 30 minutes to obtain a dispersion. The thus obtained dispersion was filtered and the residue was dried at 100° C. in vacuo, whereby about one part by weight of slightly greenish modified indium oxide 2-1 was obtained.

This modified indium oxide 2-1 was found to have exothermic peaks at 290° C. and 320° C. by a differential thermal analysis.

PREPARATION EXAMPLE 2-2

Preparation of Modified Indium Oxide 2-2

One part by weight of finely-divided particles of indium oxide with an average particle diameter of 0.01 to 0.03 μm and 3 parts by weight of n-butylethylamine were placed in a glass container equipped with a reflux condenser. The above mixture was refluxed with stirring for one hour, whereby a dispersion was obtained.

The thus obtained dispersion was filtered and the residue was dried at 100° C. in vacuo, whereby greenish modified indium oxide 2-2 was obtained. This modified indium oxide 2-2 was found to have exothermic peaks at 290° C. and 320° C. by a differential thermal analysis.

PREPARATION EXAMPLE 2-3

Preparation of Modified Indium Oxide 2-3

One part by weight of finely-divided particles of indium oxide with an average particle diameter of 0.01 to 0.03 μm and 3 parts by weight of triethylamine were placed in a glass container equipped with a reflux condenser. The above mixture was refluxed with stirring for one hour to obtain a dispersion. The thus obtained dispersion was filtered and the residue was dried at 100° C. in vacuo, whereby greenish modified indium oxide 2-3 was obtained.

This modified indium oxide 2-3 was found to have an exothermic peak at 325° C. by the differential thermal analysis.

PREPARATION EXAMPLE 2-4

Preparation of Modified Indium Oxide 2-4

One part by weight of finely-divided particles of indium oxide with an average particle diameter of 0.01 to 0.03 μm and 3 parts by weight of pyridine were placed in a glass container equipped with a reflux condenser. The above mixture was heated to 60° C. with stirring for one hour. The mixture was then subjected to an ultrasonic treatment for 30 minutes, whereby a dispersion was obtained.

The thus obtained dispersion was filtered and the residue was dried at 100° C. in vacuo, whereby about one part by weight of slightly greenish modified indium oxide 2-4 was obtained.

EXAMPLE 2-1

Formation of Undercoat Layer 24 g of finely-divided particles of the above-prepared modified indium oxide 2-1 and 64 g of a cyclohexane solution of a commercially available butyral resin (Trademark "S-Lec BL-1", made by Sekisui Chemical Co., Ltd., with a solid component content of amount of 6.3 wt. %, were placed in a 9-cm diameter hard glass pot, together with YTZ zirconia balls with a diameter of 0.5 cm which took up a half of the pot.

The above mixture was subjected to milling for 3 days. After the completion of milling, 41 g of a methyl ethyl ketone solution of a commercially available isocyanate type curing agent (Trademark "Barnock D750", made by Dainippon Ink & Chemicals, Incorporated) with a content of 2 wt. % was added to the above mixture, followed by shaking the mixture for about 5 minutes. Thus, an undercoat layer coating liquid was prepared.

The thus prepared undercoat layer coating liquid was spray-coated on an aluminum drum with a thickness of 80 mm and dried at 130° C. for one hour, so that an undercoat layer with a thickness of about 2 μm was formed on the aluminum drum substrate.

Preparation of Charge Generation Layer 20 g of the same azo pigment as employed in Example 1.1 and 300 g of a cyclohexane solution of a commercially available butyral resin (Trademark "XYHL", made by Union Carbide Corp.) with a solid component content of 0.2 wt. % were placed in a 15-cm diameter glass pot, together with YTZ zirconia balls with a diameter of 1.0 cm which took up a half of the pot.

The above mixture was subjected to milling over a period of 120 hours. After the completion of milling, 500 g of methyl ethyl ketone was added to the above mixture, followed by additional milling for 24 hours. Thus, a charge generating layer coating liquid was prepared.

The thus prepared charge generating layer coating liquid was dip-coated on the above prepared undercoat layer and dried at 120° C. for about 20 minutes, so that a charge generation layer with a thickness of about 0.1 μm was formed on the undercoat layer.

Preparation of Charge Transport Layer

The following components were mixed to prepare a charge transport layer coating liquid:

| | Parts by Weight |
|---|---|
| 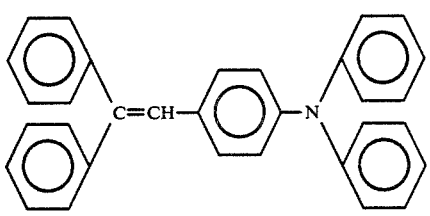 | 80 |
| Polycarbonate (Trademark "Panlite C1400", made by Teijin Limited.) | 100 |
| Silicone oil (Trademark "KF-50", made by Shin-Etsu Silicone Co., Ltd.) | 0.3 |
| Methylene chloride | 900 |

The above prepared charge transport layer coating liquid was dip-coated on the above prepared charge generation layer and dried at 120° C. for 30 minutes, so that a charge transport layer with a thickness of about 25 μm was formed on the charge generation layer.

Thus, electrophotographic photoconductor No. 2-1 according to the present invention was prepared.

EXAMPLE 2-2

The procedure for preparation of electrophotographic photoconductor No. 2-1 in Example 2-1 was repeated except that the modified indium oxide 2-1 employed in the undercoat layer in Example 2-1 was replaced by the modified indium oxide 2-2 which was prepared in Preparation Example 2-2, and except that the charge transport layer coating liquid employed in Example 2-1 was replaced by a charge transport layer coating liquid with the following formulation, whereby electrophotographic photoconductor No. 2-2 according to the present invention was prepared.

| | Parts by Weight |
|---|---|
| 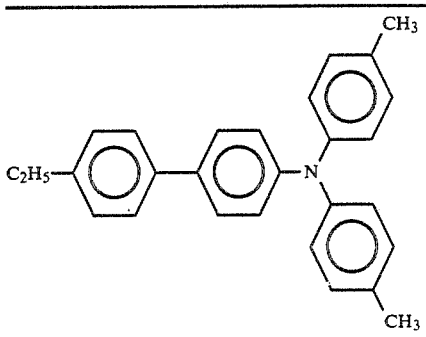 | 80 |
| Polycarbonate (Trademark "Panlite C1400", made by Teijin Limited. | 100 |
| Silicone oil (Trademark "KF-50", made by Shin-Etsu Silicone Co., Ltd.) | 0.3 |
| Methylene chloride | 900 |

EXAMPLE 2-3

The procedure for preparation of electrophotographic photoconductor No. 2-1 in Example 2-1 was repeated except that the modified indium oxide 2-1 employed in the undercoat layer in Example 2-1 was replaced by the modified indium oxide 2-3 which was prepared in Preparation Example 2-3, whereby electrophotographic photoconductor No. 2-3 according to the present invention was prepared.

EXAMPLE 2-4

The procedure for preparation of electrophotographic photoconductor No. 2-1 in Example 2-1 was repeated except that the modified indium oxide 2-1 employed in the undercoat layer in Example 2-1 was replaced by the modified indium oxide 2-4 which was prepared in Preparation Example 2-4, whereby electrophotographic photoconductor No. 2-4 according to the present invention was prepared.

EXAMPLES 2-5 to 2-7

The procedure for preparation of electrophotographic photoconductor No. 2-1 in Example 2-1 was repeated except that the solid component content in the cyclohexane solution of the butyral resin (Trademark "S-Lec BL-1", made by Sekisui Chemical Co., Ltd.) employed in Example 2-1 was changed to 4.7 wt. %, 5.4 wt. %, and 7.5 wt. %, whereby electrophotographic photoconductors No. 2-5 to No. 2-7 according to the present invention were respectively prepared.

COMPARATIVE EXAMPLES 2-1 to 2-4

The procedure for preparation of electrophotographic photoconductor No. 2-1 in Example 2-1 was repeated except that the modified indium oxide 2-1 employed in the undercoat layer in Example 2-1 was replaced by an unmodified indium oxide, and except that the solid component content in the cyclohexanone solution of the butyral resin (Trademark "S-Lec BL-1", made by Sekisui Chemical Co., Ltd.) employed in Example 2-1 was changed to 4.7 wt. %, 5.4 wt. %, 6.3 wt. % and 7.5 wt. %, whereby comparative electrophotographic photoconductors No. 2-1 to No. 2-4 were respectively prepared.

COMPARATIVE EXAMPLE 2-5

The procedure for preparation of electrophotographic photoconductor No. 2-1 in Example 2-1 was repeated except that the modified indium oxide 2-1 employed in the undercoat layer in Example 2-1 was replaced by the comparative modified indium oxide 1-1 which was prepared in Comparative Preparation Example 1-1, whereby comparative electrophotographic photoconductor No. 2-5 was prepared.

Each of the above-prepared electrophotographic photoconductors No. 2-1 to No. 2-7 according to the present invention and comparative electrophotographic photoconductors No. 2-1 to No. 2-5 was evaluated with respect to the changes in the chargeability ($V_D$), photosensitivity ($V_L$) and residual potential ($V_R$) during the repeated use thereof and with respect to the surface potential after charging ($V'_D$), the surface potential after exposure ($V'_L$) and the surface potential after quenching ($V'_R$) in the same manner as in the previously mentioned electrophotographic photoconductors No. 1-1 to No. 1-8 according to the present invention and comparative electrophotographic photoconductors No. 1-1 to No. 1-5. The evaluation results are given in Table 2.

TABLE 2

| | Compound for pretreatment of Indium Oxide | Ratio of Modified Indium Oxide/ Binder Resin | Initial Characteristics | | | Characteristics after Repeated Operations | | |
|---|---|---|---|---|---|---|---|---|
| | | | $V_D$ | $V_L$ | $V_R$ | $V'_D$ | $V'_L$ | $V'_R$ |
| Ex. 1-1 | n-butylamine | 6/1 | 905 | 130 | 20 | 880 | 140 | 30 |
| Ex. 1-2 | n-butylethylamine | 6/1 | 910 | 135 | 25 | 885 | 140 | 30 |
| Ex. 1-3 | Triethylamine | 6/1 | 895 | 125 | 20 | 870 | 130 | 25 |
| Ex. 1-4 | Pyridine | 6/1 | 920 | 135 | 20 | 900 | 135 | 30 |
| Ex. 1-5 | n-butylamine | 8/1 | 890 | 125 | 15 | 870 | 130 | 20 |
| Ex. 1-6 | n-butylamine | 7/1 | 885 | 120 | 15 | 865 | 130 | 25 |
| Ex. 1-7 | n-butylamine | 5/1 | 920 | 145 | 30 | 905 | 155 | 35 |
| Comp. Ex. 1-1 | Not pretreated | 8/1 | 930 | 140 | 20 | 685 | 150 | 30 |
| Comp. Ex. 1-2 | Not pretreated | 7/1 | 925 | 155 | 25 | 705 | 165 | 40 |
| Comp. Ex. 1-3 | Not pretreated | 6/1 | 950 | 170 | 30 | 780 | 190 | 55 |
| Comp. Ex. 1-4 | Not pretreated | 5/1 | 980 | 180 | 45 | 895 | 200 | 70 |
| Comp. Ex. 1-5 | Methylene chloride | 6/1 | 870 | 140 | 30 | 750 | 155 | 45 |

PREPARATION EXAMPLE 3-1

Preparation of Modified Indium Oxide 3-1

One part by weight of finely-divided particles of indium oxide with an average particle diameter of 0.01 to 0.03 μm and 5 parts by weight of dioxane were placed in a glass container equipped with a reflux condenser. The above mixture was refluxed with stirring for one hour.

The mixture was then subjected to an ultrasonic treatment for 30 minutes to obtain a dispersion. The thus obtained dispersion was filtered and the residue was dried at 100° C. in vacuo, whereby about one part by weight of slightly greenish modified indium oxide 3-1 was obtained.

PREPARATION EXAMPLE 3-2

Preparation of Modified Indium Oxide 3-2

One part by weight of finely-divided particles of indium oxide with an average particle diameter of 0.01 to 0.03 μm and 10 parts by weight of ethylene glycol diethyl ether were placed in a glass container equipped with a reflux condenser. The above mixture was refluxed with stirring for one hour, whereby a dispersion was obtained.

The thus obtained dispersion was filtered and the residue was dried at 100° C. in vacuo, whereby greenish modified indium oxide 3-2 was obtained.

PREPARATION EXAMPLE 3-3

Preparation of Modified Indium Oxide 3-3

One part by weight of finely-divided particles of indium oxide with an average particle diameter of 0.01 to 0.03 μm and 10 parts by weight of isopropyl ether were placed in a glass container equipped with a reflux condenser. The above mixture was refluxed with stirring for one hour to obtain a dispersion.

The thus obtained dispersion was filtered and the residue was dried at 100° C. in vacuo, whereby greenish modified indium oxide 3-3 was obtained. This modified indium oxide 3-3 was found to have exothermic peaks at 295° C. and 315° C. by the differential thermal analysis.

PREPARATION EXAMPLE 3-4

Preparation of Modified Indium Oxide 3-4

One part by weight of finely-divided particles of indium oxide with an average particle diameter of 0.01 to 0.03 μm and 20 parts by weight of a methylene chloride solution of a commercially available polyethylene glycol alkyl ether (Trademark "Emulmin 40", made by Sanyo Chemical Industries, Ltd.) with a solid component content of 1.3 wt. % were placed in a glass container equipped with a reflux condenser. The above mixture was refluxed with stirring for one hour.

The mixture was then subjected to an ultrasonic treatment for 30 minutes, whereby a dispersion was obtained.

The thus obtained dispersion wa filtered and the residue was dried at 100° C. in vacuo, whereby about one part by weight of modified indium oxide 3-4 was obtained.

EXAMPLE 3-1

Formation of Undercoat Layer 24 g of finely-divided particles of the above-prepared modified indium oxide 3-1 and 64 g of a cyclohexane solution of a commercially available butyral resin (Trademark "S-Lec BL-1", made by Sekisui Chemical Co., Ltd., with a solid component content of amount of 6.3 wt. %, were placed in a 9-cm diameter hard glass pot, together with YTZ zirconia balls with a diameter of 0.5 cm which occupied a half capacity of the pot.

The above mixture was subjected to milling for 3 days. After the completion of milling, 41 g of a methyl ethyl ketone solution of a commercially available isocyanate type curing agent (Trademark "Barnock D750", made by Dainippon Ink & Chemicals, Incorporated) with a content of 2 wt. % was added to the above mixture, followed by shaking the mixture for about 5 minutes. Thus, an undercoat layer coating was prepared.

The thus prepared undercoat layer coating liquid was spray-coated on an aluminum drum with a thickness of 80 mm and dried at 130° C. for one hour, so that an undercoat layer with a thickness of about 2 μm was formed on the aluminum drum substrate.

Preparation of Charge Generation Layer 20 g of the same azo pigment as employed in Example 1-1 and 300 g of a cyclohexane solution of a commercially available butyral resin (Trademark "XYHL", made by Union Carbide Corp.), with a solid component content of 0.2 wt. %) were placed in a 15-cm diameter glass pot, together with YTZ zirconia balls with a diameter of 1.0 cm which took up a half of the pot.

The above mixture was subjected to milling over a period of 120 hours. After the completion of milling, 500 g of methyl ethyl ketone was added to the above mixture, followed by additional milling for 24 hours. Thus, a charge generating layer coating liquid was prepared.

The thus prepared charge generating layer coating liquid was dip-coated on the above prepared undercoat layer and dried at 120° C. for about 20 minutes, so that a charge generation layer with a thickness of about 0.1 μm was formed on the undercoat layer.

Preparation of Charge Transport Layer

The following components were mixed to prepare a charge transport layer coating liquid:

| | Parts by Weight |
|---|---|
| 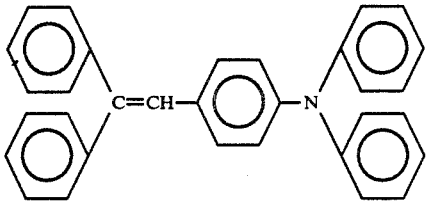 | 80 |
| Polycarbonate (Trademark "Panlite C1400", made by Teijin Limited.) | 100 |
| Silicone oil (Trademark "KF-50", made by Shin-Etsu Silicone Co., Ltd.) | 0.3 |
| Methylene chloride | 900 |

The above prepared charge transport layer coating liquid was dip-coated on the above prepared charge generation layer and dried at 120° C. for 30 minutes, so that a charge transport layer with a thickness of about 25 μm was formed on the charge generation layer.

Thus, electrophotographic photoconductor No. 3-1 according to the present invention was prepared.

EXAMPLE 3-2

The procedure for preparation of electrophotographic photoconductor No. 3-1 in Example 3-1 was repeated except that the modified indium oxide 3-1 employed in the undercoat layer for Example 3-1 was replaced by the modified indium oxide 3-2 which was prepared in Preparation Example 3-2, and except that the charge transport layer coating liquid employed in Example 3-1 was replaced by a charge transport layer coating liquid with the following formulation, whereby electrophotographic photoconductor No. 3-2 according to the present invention was prepared.

| | Parts by Weight |
|---|---|
| 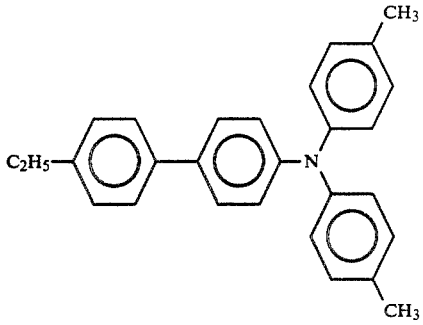 | 80 |
| Polycarbonate (Trademark "Panlite C1400", made by Teijin Limited. | 100 |
| Silicone oil (Trademark "KF-50", made by Shin-Etsu Silicone Co., Ltd.) | 0.3 |
| Methylene chloride | 900 |

EXAMPLE 3-3

The procedure for preparation of electrophotographic photoconductor No. 3-1 in Example 3-1 was repeated except that the modified indium oxide 3-1 employed in the undercoat layer of Example 3-1 was replaced by the modified indium oxide 3-3 which was prepared in Preparation Example 3-3, whereby electrophotographic photoconductor No. 3-3 according to the present invention was prepared.

EXAMPLE 3-4

The procedure for preparation of electrophotographic photoconductor No. 3-1 in Example 3-1 was repeated except that the modified indium oxide 3-1 employed in the undercoat layer of Example 3-1 was replaced by the modified indium oxide 3-4 which was prepared in Preparation Example 3-4, and except that the solid component content in the cyclohexanone solution of the butyral resin (Trademark "S-Lec BL-1", made by Sekisui Chemical Co., Ltd.) employed in Example 3-1 was changed to 3.7 wt. %, whereby electrophotographic photoconductor No. 3-4 according to the present invention was prepared.

EXAMPLES 3-5 to 3-7

The procedure for preparation of electrophotographic photoconductor No. 3-1 in Example 3-1 was repeated except that the solid component content in the cyclohexanone solution of the butyral resin (Trademark "S-Lec BL-1", made by Sekisui Chemical Co., Ltd.) employed in Example 3-1 was changed to 4.7 wt. %, 5.4 wt. %, and 7.5 wt. %, whereby electrophotographic photoconductors No. 3-5 to No. 3-7 according to the present invention were prepared.

COMPARATIVE EXAMPLES 3-1 to 3-4

The procedure for preparation of electrophotographic photoconductor No. 3-1 in Example 3-1 was repeated except that the modified indium oxide 3-1 employed in the undercoat layer in Example 3-1 was replaced by an unmodified indium oxide, and except that the solid component content in the cyclohexanone solution of the butyral resin (Trademark "S-Lec BL-1", made by Sekisui Chemical Co., Ltd.) employed in Example 3-1 was changed to 4.7 wt. %, 5.4 wt. %, 6.3 wt. % and 7.5 wt. %, whereby comparative electrophotographic photoconductors No. 3-1 to No. 3-4 were respectively prepared.

COMPARATIVE EXAMPLE 3-5

The procedure for preparation of electrophotographic photoconductor No. 3-1 in Example 3-1 was repeated except that the modified indium oxide 3-1 employed in the undercoat layer of Example 3-1 was replaced by the comparative modified indium oxide 1-1 which was prepared in Comparative Preparation Example 1-1, whereby comparative electrophotographic photoconductor No. 3-5 was prepared.

Each of the above prepared electrophotographic photoconductors No. 3-1 to No. 3-7 according to the present invention and comparative electrophotographic photoconductors No. 3-1 to No. 3-5 was evaluated with respect to the changes in the chargeability ($V_D$), photosensitivity ($V_L$) and residual potential ($V_R$) during the repeated use thereof and with respect to the surface potential after charging ($V'_D$), the surface potential after exposure ($V'_L$) and the surface potential after quenching ($V'_R$) in the same manner as in the previously mentioned electrophotographic photoconductors No. 1-1 to No. 1-8 according to the present invention and comparative electrophotographic photoconductors No. 1-1 to No. 1-5. The evaluation results are given in Table 3.

TABLE 3

| | Compound for pretreatment of Indium Oxide | Ratio of Modified Indium Oxide/ Binder Resin | Initial Characteristics | | | Characteristics after Repeated Operations | | |
|---|---|---|---|---|---|---|---|---|
| | | | $V_D$ | $V_L$ | $V_R$ | $V'_D$ | $V'_L$ | $V'_R$ |
| Ex. 1-1 | Dioxane | 6/1 | 895 | 120 | 15 | 870 | 125 | 20 |
| Ex. 1-2 | Ethylene glycol diethyl ether | 6/1 | 900 | 125 | 20 | 880 | 135 | 25 |
| Ex. 1-3 | Isopropyl ether | 6/1 | 890 | 120 | 15 | 860 | 130 | 20 |
| Ex. 1-4 | Polyethylene glycol alkyl ether | 10/1 | 910 | 130 | 20 | 895 | 140 | 30 |
| Ex. 1-5 | Dioxane | 8/1 | 885 | 120 | 10 | 860 | 125 | 20 |
| Ex. 1-6 | Dioxane | 7/1 | 885 | 125 | 10 | 865 | 130 | 15 |
| Ex. 1-7 | Dioxane | 5/1 | 920 | 135 | 20 | 910 | 145 | 35 |
| Comp. Ex. 1-1 | Not pretreated | 8/1 | 930 | 140 | 20 | 685 | 150 | 30 |
| Comp. Ex. 1-2 | Not pretreated | 7/1 | 925 | 155 | 25 | 705 | 165 | 40 |
| Comp. Ex. 1-3 | Not pretreated | 6/1 | 950 | 170 | 30 | 780 | 190 | 55 |
| Comp. Ex. 1-4 | Not pretreated | 5/1 | 980 | 180 | 45 | 895 | 200 | 70 |
| Comp. Ex. 1-5 | Methylene chloride | 6/1 | 870 | 140 | 30 | 750 | 155 | 45 |

As can be seen from the evaluation results shown in Tables 1, 2 and 3, the deterioration in the chargeability of the photoconductors according to the present invention, is remarkably small. The charging characteristics of the photoconductors according to the present invention do not degrade and the build-up of the residual potential is extremely slight even though the charging and exposure processes are repeated. The electrophotographic photoconductors of the present invention are capable of producing high quality images with high uniformity.

What is claimed is:

1. In an electrophotographic photoconductor comprising an electroconductive substrate, an undercoat layer formed on said electroconductive substrate, and a photoconductive layer comprising a charge generation layer and a charge transport layer formed on said undercoat layer, the improvement wherein said undercoat layer comprises a binder resin and a modified indium oxide having exothermic peaks in the range of 200° to 600° C. when detected by the differential thermal analysis, which modified indium oxide is prepared by pretreatment with an organic compound selected from the group consisting of a hydroxyl-group-containing compound, an amino-group-containing compound, and an ether-group-containing compound.

2. The electrophotographic photoconductor as claimed in claim 1, wherein said modified indium oxide is prepared by pretreatment with a hydroxyl-group-containing compound.

3. The electrophotographic photoconductor as claimed in claim 2, wherein said hydroxyl-group-containing compound is an alcohol selected from the group consisting of methanol, ethanol, propanol, butanol, amyl alcohol, fusel oil, methoxybutyl alcohol, hexanol, methyl pentanol, ethylbutyl alcohol, heptanol, octanol, ethylhexyl alcohol, nonylalcohol, dimethyl heptanol, decanol, undecyl alcohol, trimethyl nonylalcohol, tetradecyl alcohol, heptadecyl alcohol, cyclohexanol, methylcyclohexanol, trimethylcyclohexanol, benzyl alcohol, phenylmethyl carbinol, ethylene glycol, propylene glycol, butylene glycol, pentanediol, hexandiol, triethylene glycol, tripropylene glycol, glycerol, heptanediol, diethylene glycol and dipropylene glycol.

4. The electrophotographic photoconductor as claimed in claim 2, wherein said hydroxyl-group-containing compound is selected from the group consisting of methyl cellosolve, ethyl cellosolve, butyl cellosolve, ethylene glycol monohexyl ether, ethylene glycol monophenyl ether, methyl carbitol, ethyl carbitol, butyl carbitol, hexyl carbitol, terpene glycol ether, tetrahydrofurfuryl alcohol and diacetone alcohol.

5. The electrophotographic photoconductor as claimed in claim 2, wherein said hydroxyl-group-containing compound is selected from the group consisting of polyvinyl alcohol, polyvinyl acetal, phenoxy resin, polyester, alkyd resin and polyalkylene glycol.

6. The electrophotographic photoconductor as claimed in claim 2, wherein said hydroxyl-group-containing compound is a resin containing hydroxyl-group-containing acrylmonomer-units.

7. The electrophotographic photoconductor as claimed in claim 2, wherein said hydroxyl-group-containing compound is a vinyl-acetate resin.

8. The electrophotographic photoconductor as claimed in claim 1, wherein said modified indium oxide is prepared by pretreatment with an amino-group-containing compound.

9. The electro-photographic photoconductor as claimed in claim 8, wherein said amino-group-containing compound is selected from the group consisting of diethylamine, triethylamine, propylamine, dipropylamine, isopropylamine, butylamine, dibutylamine, tributylamine, amylamine, diamylamine, triamylamine, ethylenediamine, propylenediamine, aniline, pyridine, quinoline and cyclohexylamine.

10. The electrophotographic photoconductor as claimed in claim 1, wherein said modified indium oxide is prepared by pretreatment with an ether-group-containing compound.

11. The electrophotographic photoconductor as claimed in claim 10, wherein said ether-containing compound is selected from the group consisting of isopropyl ether, butyl ether, hexyl ether, alkyl ethers of ethylene glycol, alkyl ethers of diethylene glycol, alkyl ethers of glycerol, polyglycerols, polyalkylene oxides, polyphenylene oxides; and cyclic ethers and polyvinyl ethers.

12. The electrophotographic photoconductor as claimed in claim 1, wherein said modified indium oxide is prepared by mixing indium oxide and said organic compound under application of heat thereto.

13. The electrophotographic photoconductor as claimed in claim 1, wherein said binder resin comprises a reaction product of a compound having a plurality of active hydrogens and an isocyanate-group-containing compound.

14. The electrophotographic photoconductor as claimed in claim 13, wherein said compound having a plurality of active hydrogen is selected from the group consisting of polyvinyl acetal, phenoxy resin, polyamide, polyester, alkyd resin, polyalkylene glycol, acrylic polymers containing therein hyiroxyethyl methacrylate units, and vinyl acetate polymers containing therein vinyl alcohol units.

15. The electrophotographic photoconductor as claimed in claim 13, wherein said isocyanate-group-containing compound is selected from the group consisting of methyl isocyanate, ethyl isocyanate, propyl isocyanate, butyl isocyanate, phenyl isocyanate, tolyl isocyanate, naphthyl isocyanate, nitrophenyl isocyanate, and vinyl isocyanate.

16. The electrophotographic photoconductor as claimed in claim 13, wherein said isocyanate-group-containing compound is selected from the group consisting of tolylene diisocyanate, hexamethylene diisocyanate, o-tolyl diisocyanate, diphenylmethane diisocyanate, naphthylene diisocyanate and a dimer of tolylene diisocyanate.

17. The electrophotographic photoconductor as claimed in claim 13, wherein said isocyanate-group-containing compound is selected from the group consisting of triphenylmethane triisocyanate, and tris-(p-isocyanate phenyl)thiophosphate.

18. The electrophotographic photoconductor as claimed in claim 13, wherein said isocyanate-group-containing compound is selected from the group consisting of polyfunctional isocyanate compounds having a plurality of diisocyanate compounds and/or triisocyanate compounds.

19. The electrophotographic photoconductor as claimed in claim 1, wherein the amount of said modified indium oxide is 70 wt. %, or more of the total weight of modified indium oxide and said binder resin in said undercoat layer.

20. The electrophotographic photoconductor as claimed in claim 1, wherein said undercoat layer has a thickness of 0.2 to 20 μm.

21. The electrophotographic photoconductor as claimed in claim 1, further comprising a protective layer provided on said photoconductive layer.

22. The electrophotographic photoconductor as claimed in claim 1, further comprising an adhesive layer which is interposed between said electroconductive substrate and said undercoat layer.

* * * * *

UNITED STATES PATENT AND TRADEMARK OFFICE

CERTIFICATE OF CORRECTION

PATENT NO. : 5,135,829

DATED : August 4, 1992

INVENTOR(S) : Toshio Fukagai, et al

It is certified that error appears in the above-identified patent and that said Letters Patent is hereby corrected as shown below:

Column 1, line 31, after "materials" delete "an", insert --and--.

Column 2, line 53, after "compound" delete "a", insert --as--.

Column 2, line 60, after "order", insert --to--.

Column 7, line 36, delete "along", insert --alone--.

Column 24, line 15, delete "hyiroxyethyl", insert --hydroxyethyl--.

Signed and Sealed this

Seventh Day of December, 1993

*Attest:*

*Attesting Officer*

BRUCE LEHMAN

*Commissioner of Patents and Trademarks*